United States Patent [19]

Greene

[11] Patent Number: 4,889,340

[45] Date of Patent: Dec. 26, 1989

[54] SPHERICAL PUZZLE

[76] Inventor: Wilton R. Greene, 462 W. Hayne St., Woodruff, S.C. 29388

[21] Appl. No.: 907,845

[22] Filed: Sep. 10, 1986

Related U.S. Application Data

[63] Continuation-in-part of Ser. No. 673,276, Nov. 20, 1984, abandoned.

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,441,715 4/1984 Titus ..... 273/153 S

FOREIGN PATENT DOCUMENTS 3127757 2/1983 Fed. Rep. of Germany ... 273/153 S
3138050 4/1983 Fed. Rep. of Germany ... 273/153 S
82/00101 1/1982 PCT Int'l Appl. ..... 273/153 S
2088728 2/1982 United Kingdom ..... 273/153 S

*Primary Examiner*—Anton O. Oechsle
*Attorney, Agent, or Firm*—Dority & Manning

[57] ABSTRACT

A puzzle including track sections which join together to provide circumferential tracks which carry movable circumferential members. The track sections are movable about one another in a plurality of planes to allow the forming of a variety of combinations. The circumferential members have characters printed thereon. The track sections are rotated, causing the circumferential members to be shifted from one circumferential track to another at track junctions in order to form predetermined patterns according to a particular game objective.

30 Claims, 6 Drawing Sheets

SPHERICAL PUZZLE

BACKGROUND OF THE INVENTION

This is a continuation-in-part of application Ser. No. 673,276, filed Nov. 20, 1984, entitled "Spherical Puzzle" now abandoned.

Manipulative puzzles having blocks which are movable with respect to one another have become very popular recently. For example, the "Rubik's Cube" (upon which a Hungarian patent application No. 170062 was filed on Feb. 28, 1978), has met with wide-spread commercial success. The Rubik's Cube has six faces, each face being comprised of nine blocks which are movable in two perpendicular directions. Originally, all of the blocks on a particular face are of the same color. The object of the Rubik's Cube puzzle is, after scrambling the blocks so that each face of the cube is made up of a variety of colored blocks, to unscramble the blocks so that each face of the cube is again comprised of blocks all having the same color. The movement of the blocks relative to one another is permitted by a multipart spider mechanism carried in the center of the cube.

Another puzzle having movable square blocks is disclosed in applicant's earlier patent, U.S. Pat. No. 4,452,454 granted on June 5, 1984. There, a manipulative puzzle is disclosed where square blocks are moved about a sphere in tracks extending in different directions about different axes of the sphere.

In U.S. Pat. No. 3,081,089, a mechanical puzzle is disclosed which includes a plurality of different colored parts movable relative to each other for the purpose of forming various patterns.

While the above puzzles, particularly the Rubik's Cube, initially present a challenge to the player, the novelty of the puzzle often diminishes over time. Thus, it would be desirable to produce a puzzle which is capable of supplying a variety of different games having varying levels of difficulty so that a challenge to the player is always presented by the puzzle.

SUMMARY OF THE INVENTION

The puzzle constructed in accordance with the present invention includes a substantially spherical support member which carries a plurality of abutting track sections which are movable about the surface of the sphere. Where the track sections abut one another, circumferential tracks are formed which carry square blocks. The square blocks are movable along the circumferential tracks. Because the track sections are movable relative to the sphere, different combinations and sequences of the circumferential tracks, and hence of the movable square blocks can be formed.

In one particular embodiment, the movable track sections each have an opening which allows the surface of the spherical support member underneath that particular track section to be viewed. Symbols can be printed on the surface of the spherical support member for the purpose of being viewed through the track section openings, thereby increasing the versatility of the puzzle and the number of games that can be played using the puzzle.

In order to allow the track sections to move relative to one another about the surface of the spherical support member and to allow the movable square blocks to stay on the track sections as they are moved, spring flanges are provided on the track sections. The spring flanges hold the movable blocks on the circumferential tracks as the track sections are moved relative to one another. The spring flanges are flexible and engage grooves in the sides of the movable blocks and permit the blocks to be moved over a junction, which is created at the abutment of adjacent track sections, without becoming disengaged with the circumferential tracks.

Symbols such as letters of the alphabet and/or numbers, can be printed on the movable blocks. The blocks can be of different colors to further increase the variety of games that can be played with the puzzle. By providing playing card symbols on the surface of the spherical support members which are viewable through the track section openings, games analagous to ordinary card games can be played with the puzzle.

In one game that can be played with the puzzle, the colored blocks are scrambled, and the player has to return them to the unscrambled position within a certain amount of time. In another game, words are formed by moving the lettered blocks about the various circumferential tracks. The number of times that a player gets to move the blocks can be determined using dice.

In an alternate embodiment of the present invention, a manipulative game is provided comprising: a plurality of track members joined together in substantially parallel alignment with one another to form a predetermined shape; the plurality of track members including a first track member and a second track member; the first track member being movable relative to the second track member; track means provided between the plurality of track members for allowing the first track member to be movable about a plurality of planes relative to the second track members; and retention means engaging the track means for holding the plurality of track members in substantially parallel alignment with one another during engagement with the track means as the first track members move relative to the second track members.

In one particular version of the alternate embodiment, at least one arcuate edge is provided on each of the plurality of track members, the arcuate edges acting to form a plurality of circumferentially-extending interfaces between the plurality of track members upon the joining together of the plurality of track members for allowing the plurality of track members to be movable relative to one another. The track means includes the arcuate edges of adjacent track members acting in conjunction to form circumferentially-extending tracks adjacent the circumferentially-extending interfaces formed between the plurality of track members. The retention means includes circumferential members which slidingly engage the track members for movement on the track members.

Intersections are formed at the meeting of at least three proximate track members of the plurality of track members. The retention means includes first circumferential members and second circumferential members, the first circumferential members having a projecting portion for engaging and retaining the first and second circumferential members on the track means when the second circumferential members are at an intersection.

Accordingly, an important object of the present invention is to provide a puzzle which supplies a variety of games of differing levels of difficulty for testing the skills of the players.

Another important object of the present invention is to provide a puzzle having a simple movable block transport system which allows the blocks to move relative to one another in a variety of directions.

Another important object of the present invention is to provide a puzzle having track members which are movable relative to circumferential members carried thereon.

Yet another important object of the present invention is to provide a puzzle which does not require an internal support member.

Still another important object of the present invention is to provide a puzzle which is readily disassembable when circumferential members and/or track members are in a predetermined configuration.

Still further, another important object of the present invention is to provide a puzzle having track members which are held together for forming circumferential tracks by circumferential members.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PRESENT INVENTION

Figure 1:
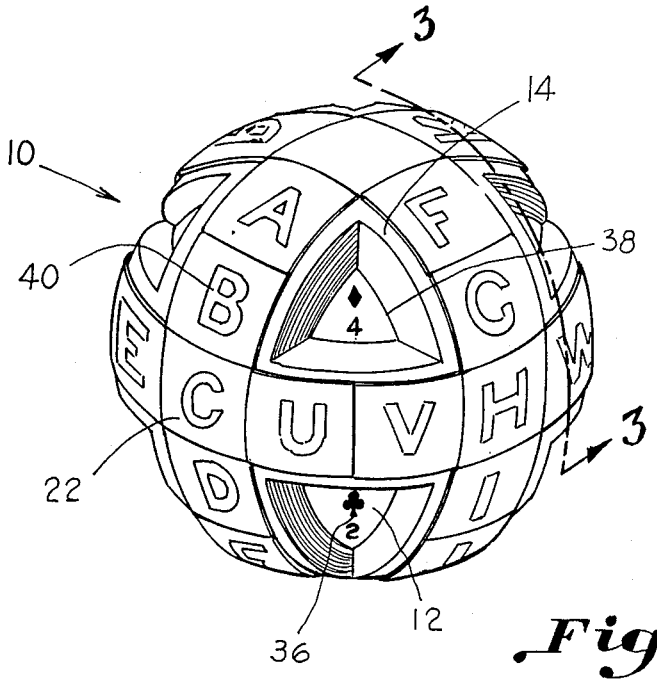
FIG. 1 is a perspective view illustrating a puzzle constructed in accordance with the present invention.
Figure 2:
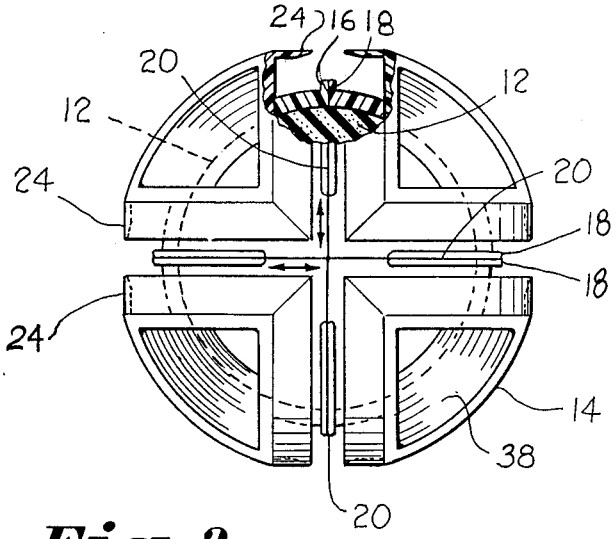
FIG. 2 is a side elevational view, with parts cut away and movable blocks removed for purposes of clarity, of a puzzle as shown in FIG. 1.
Figure 3:
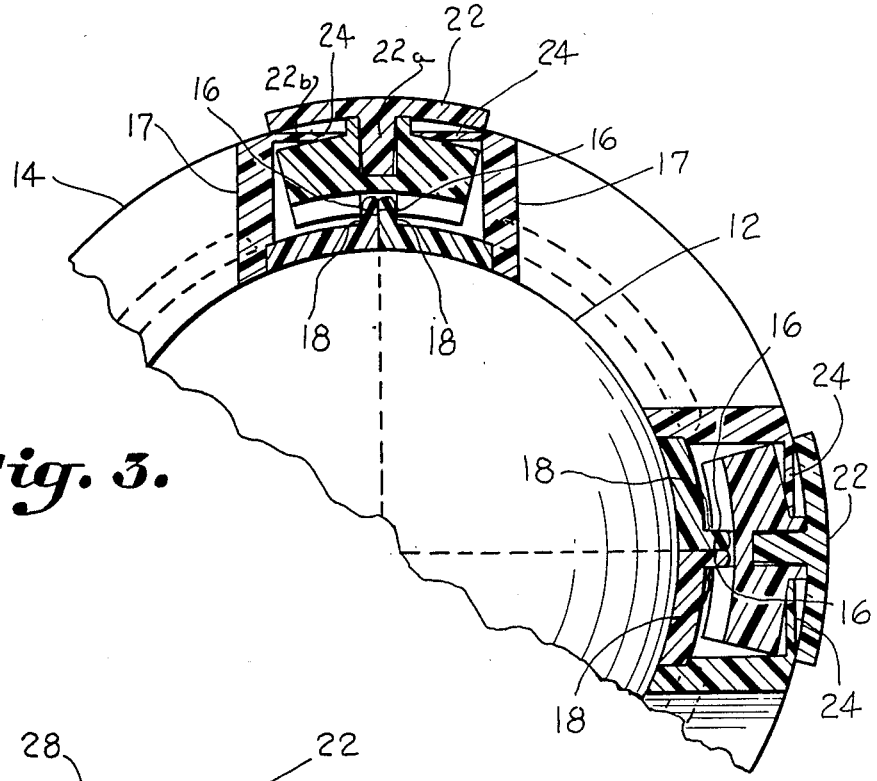
FIG. 3 is a section view taken along line 3—3 of FIG. 1.

Referring to FIG. 1 of the drawings, there is illustrated a manipulative puzzle 10 having a spherical support member 12. Upon the spherical support member 12 is carried a plurality of abutting track sections 14 which contact and cover substantially the entire surface of the spherical support member 12. As shown in FIGS. 2 and 3, each track section 14 has a plurality of straight edges 16. These straight edges 16 are in parallel abutment with one another. Track section flanges 18 project substantially radially perpendicular to and extend for substantially the length of the straight edges 16 of the track sections 14. Because the track section straight edges 16 are in parallel abutment with one another, the track section flanges 18 are also in parallel abutment with one another and serve to create a plurality of radially protruding circumferentially extending tracks 20 which extend about the surface of the spherical support member 12. A plurality of movable members 22 are carried straddlingly on the circumferential tracks 20 and are movable relative to the spherical support member 12 to any point on any of the circumferential tracks 20.

spring flanges 24 are also carried on the track sections 14 and are spaced above and extend substantially parallel to the track section flanges 18. The spring flanges 24 contact the movable members 22 by means of grooves 26 in the sides of the movable members 22. The spring flanges 24 contacting the movable members 22 urge each movable member 22 towards the circumferential track 20 it is being carried on, thereby preventing the movable member 22 from falling off the circumferential track 20.

Figure 4:
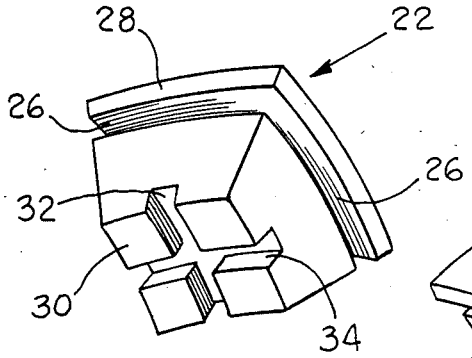
FIG. 4 is a perspective view illustrating a movable block member used in the puzzle.
Figure 6:
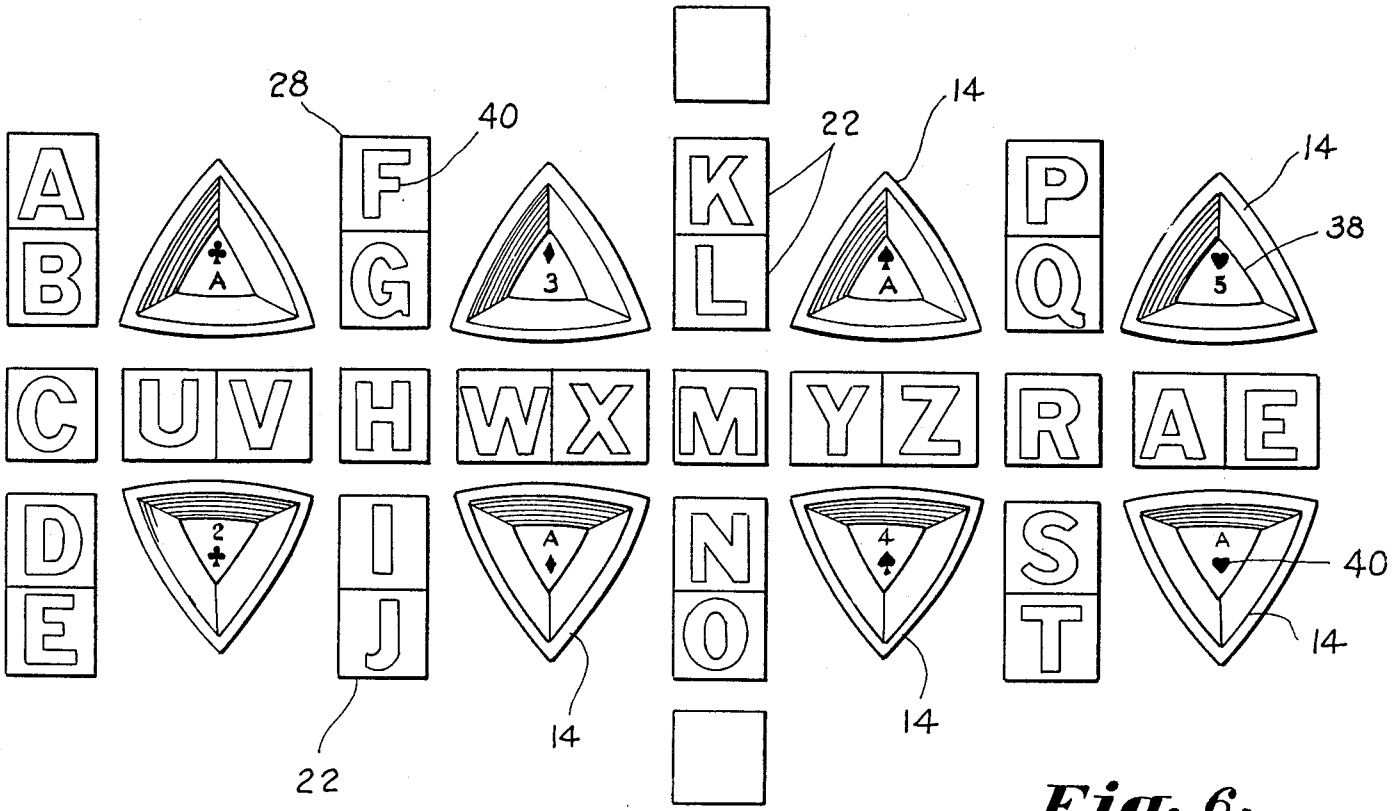
FIG. 6 is an expanded view illustrating the movable members and track sections used in the puzzle.

As shown in FIG. 4, the movable members 22 are substantially square in shape, and each one has a top surface 28 and a bottom surface 30. The bottom surface 30 of each movable member 22 is curved to conform to the curvature of the surface of the spherical support member for facilitating movement of the movable members 22 in any direction along any of the circumferential tracks 20. The bottom surface 30 of each movable member 22 also includes a first groove 32 and a second groove 34 which intersect each other at approximately the center of the bottom surface 30. Each of the grooves 32, 34 is curved throughout its length to complement the curvature of the spherical support member 12 for allowing the grooves 32, 34 to have constant contact with the circumferential tracks 20. Because the grooves 32, 34 are in constant contact with the circumferential tracks 20, smooth movement of the movable members 22 about the circumferential tracks 20 is assured.

the surface of the spherical support member 12 is relatively smooth. Symbols 36 can be applied to the surface of the spherical support member 12 and can be viewed through triangular shaped track section openings 38. The symbols 36, such as those appearing on ordinary playing cards, allow for an increased number of games to be played with the puzzle 10. As shown in FIG. 6, the movable member 22 carry characters 40 on their top surface 28, and games are played by moving the movable members 22 to various positions to create a desired sequence or combination of the characters 40 to form, for example, words or number sequences. The movable members 22 can be color-coded to enhance the difficulty of the games playable on the puzzle 10.

Each track section 14 is rotatable in a first direction and a second direction relative to the spherical support member 12. The first and second directions are perpendicular to one another and allow the track sections 14 to be moved relative to one another to create different combinations of the track sections 14 in relation to the movable members 22, thereby varying the configuration of the circumferential tracks 20.

Figure 5:
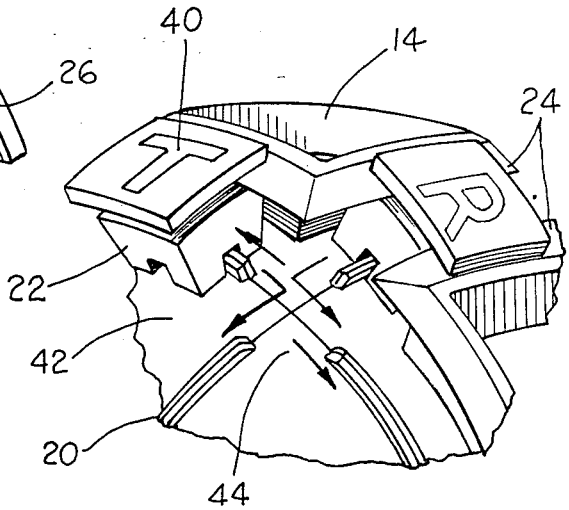
FIG. 5 is a perspective view, with parts cut away, of a track junction where two perpendicularly running circumferential tracks meet.

The circumferential tracks 20 formed by the abutting track section flanges 18 of the track sections 14 are not contiguous. Where two perpendicularly running tracks 20 approach one another creating a track junction 42, a gap 44 in each of the tracks 20 is provided thus, the perpendicularly running tracks 20 do not actually touch one another. The gap 44 is of a size approximately equal to the area occupied by the bottom surface 30 of a movable member 22. As shown in FIG. 5, when a movable member 22 is at a track junction 42, it is actually not engaged on a circumferential track 20. Consequently, the movable member 22 can either be moved straight across the gap 44 to continue on the track 20 it was on before it was moved to the track junction 42, or it can be moved to a track 20 which runs perpendicular to the track it was on prior to being moved to the track junction 42. The movable members 22 are held against the track sections 14 and aligned with the tracks 20 when they are at the track junctions 42 by the spring flanges 24 which engage in the grooves 26 on their sides.

The track sections 14 completely surround the spherical support member 12 to create a shell which covers substantially the entire spherical support member 12. The track sections 14 may move freely on the surface of the spherical support member 12 in several directions, as illustrated by arrows 100 and 102 of FIG. 2, and are retained on the surface of the spherical support member 12 by the grooves 32, 34 on the bottom surface 30 of the movable members 22, which straddlingly engage and clamp the abutting straight edges 16 of the track sections 14 together. Each track section 14 has three sides, each of which includes a straight edge 16 extending upwardly from an outer end of a flange 18, a side wall 17, and a spring flange 24. The inner edge of flange 18 is secured to the bottom of side wall 17 by any suitable means such as glueing. The movable members 22 are also normally constructed of two pieces as shown in FIG. 3 since it is easier to mold the two pieces and glue them together as compared to molding the member 22 as a single piece.

When playing a game, the movable members 22 are shifted about the circumferential tracks 20 to form sequences of letters, colors, numbers, etc. There are normally eight track sections 14 and thirty squares 22.

A movable member 22 is moved from one circumferential track to another by moving it to a track junction 42, and then transferring it to the track 20 which is perpendicular to the track the movable member 22 was on previously. When the movable member 22 is transferred to the perpendicularly running track 20, a movable member 22 on the perpendicularly running track 20 moves into the same track junction 42 to take its place on the original track 20, thereby changing the sequence of the movable member 22 on the original track 20 and allowing words or other combinations of the characters 40 carried on the movable members 22 to be formed.

The movable member 22 is molded in two pieces **22*a* and 22*b* as shown in FIG. 3 and glued together to produce a unitary member as shown in FIG. 4**.

DESCRIPTION OF ALTERNATE EMBODIMENTS

Figure 7:
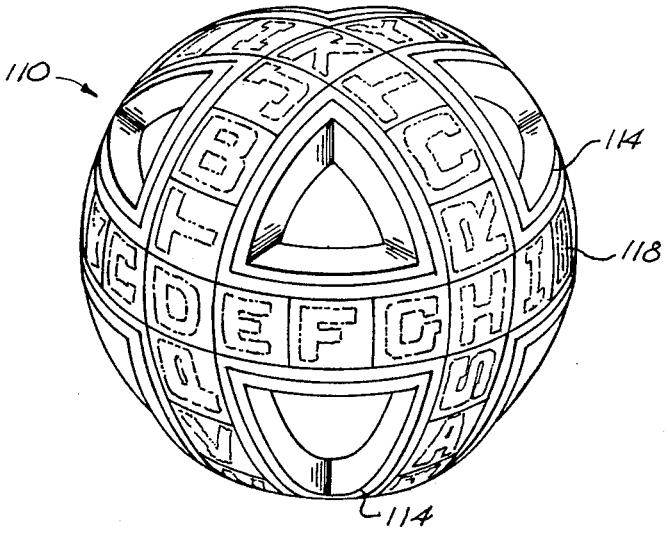
FIG. 7 is a perspective view of an alternate embodiment of a puzzle constructed in accordance with the present invention having no internal support member.

Referring to FIG. 7 of the drawings, there is illustrated an alternate embodiment manipulative puzzle 110. A plurality of track members 114 are joined together adjacent one another to form a predetermined shape, such as a substantially spherical shape as illustrated in FIG. 7. The track members 114 are movable relative to one another. Tracks 116 are provided between the track members 114 and carry circumferential members 118 having engagement surfaces 119, which slidingly engage the tracks 116 for movement thereon.

Intersections 120 are formed at the meeting of at least three adjacent track members 114. Projecting circumferential members 122 and recessed circumferential members 124 are configured so that projecting circumferential members 122 engage and retain other projecting circumferential members 122 and recessed circumferential members 124 on the tracks when the circumferential members 122, 124 are at an intersection 120.

Each track member 114 includes a plurality of arcuate edges 126. Arcuate edges 126 of the track members 114 act to form a plurality of circumferentially extending interfaces 128 between the track members 114 upon the joining together of the track members 114. Circumferentially extending interfaces 128 allow track members 114 to be movable about a plurality of planes relative to one another. Although track members 114 are illustrated as being generally sections of a substantially spherical body, it is to be understood that the exterior of track members 114 could be any of a wide variety of shapes such as cubes, cylinders, etc. and are not limited to the spherical portions herein illustrated and disclosed. This is assuming that arcuate edges 126 still act together to form circumferentially extending interfaces.

Puzzle 110 is reconfigured by grasping track sections 114 on diammetrically opposing sides of puzzle 110 and then twisting track members 114 relative to one another, in opposite directions. When track sections 114 are rotated relative to one another in such a manner, circumferential members 118 are carried therewith on tracks 116 when held with one side of the track members 114 being twisted. Thus, rotation of track members 114 relative to one another causes the positions of circumferential members 118 carried on track members 114 to be changed relative to circumferential members on other tracks 116, thereby reconfiguring the puzzle. In this manner, circumferential members 118 having letters or symbols 130 printed thereon can be moved relative to one another for the spelling of words or the creation of predetermined numerical, color, or other symbolic configurations on a track or tracks 116.

Figure 8:
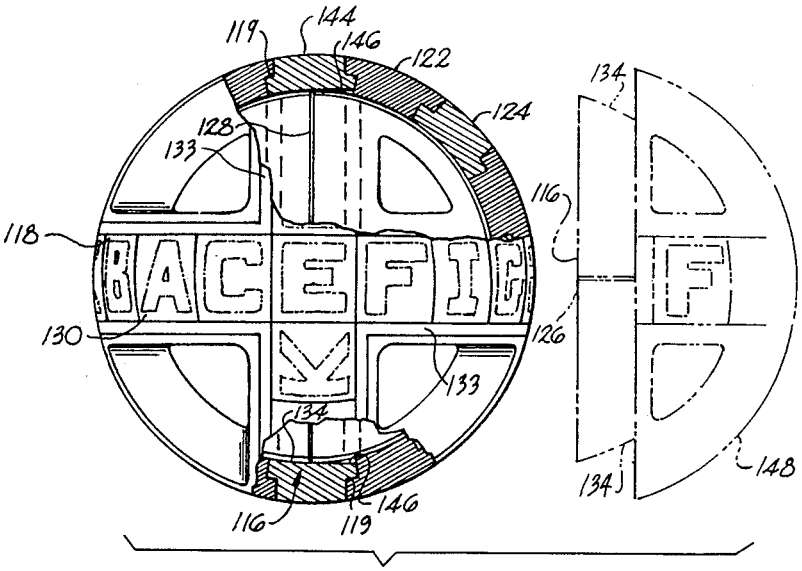
FIG. 8 is a side elevational view, with parts cut away, of a puzzle as shown in FIG. 7, illustrating the disassembable means of the alternate embodiment.
Figure 12:
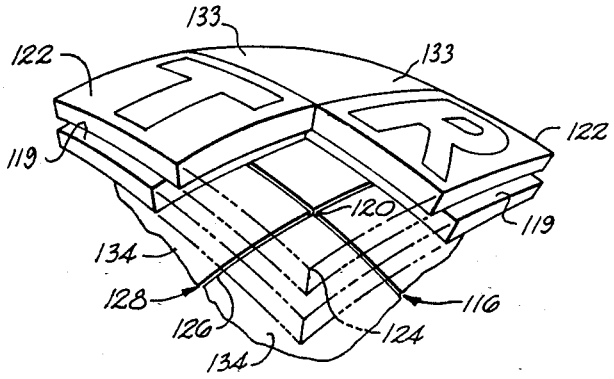
FIG. 12 is a partial perspective view of an intersection of track members of the alternate embodiment puzzle illustrated in FIGS. 7 and 8.

Tracks 116 include the arcuate edges 126 of adjacent track members 114 acting in conjunction with one another to form circumferentially-extending tracks 116 adjacent circumferentially-extending interfaces 128 formed between the track members 114. As shown in FIGS. 8 and 12, track members 114 include circumferentially-extending track member flanges 133 spaced above tracks 116 for engaging engagement surfaces 119 of circumferential members 118. As illustrated in FIG. 8, circumferentially-extending tracks 116 include curved border portions 134 defined on adjacent track members 114. The curved border portions 134 act in conjunction with one another to form the circumferentially-extending tracks 116. The curvature of border portions 134 is substantially that of the surface of a sphere having a center coincident with the center of the puzzle 110. While tracks 116 are illustrated as being created with curved border portions 134 of adjacent track members 114, it is to be understood that there are a wide variety of track configurations such as grooves or channels which could be provided the puzzle 110, and it also is to be understood that the tracks 116 of puzzle 110 are not to be limited to only tracks formed with curved border portions 134 of track members 114.

Track members 114 are retained in a predetermined shape, such as a generally spherical structure as illustrated in FIGS. 7 and 8, by retention means which include circumferential members 118. In an embodiment where tracks 116 are formed using curved border portions 134 of track members 114, circumferential members 118 are provided a curved bottom surface 136 being of curvature complementary to the curvature of curved border portions 134, such that upon engagement of circumferential members 118 with curved border portions 134, and engagement of engagement surfaces 119 with track member flanges 133, circumferential members 118 straddlingly engage, grip and retain together track members 114 on which they are carried for sliding movement.

Projecting circumferential members 122 and recessed circumferential members 124 are retained at intersections 120 of adjacent track members 114 on tracks 116. Retention of projecting and recessed circumferential members 122, 124 is achieved by the provision of interlocking profiles defined on projecting and recessed circumferential members 122, 124.

Figure 11A:
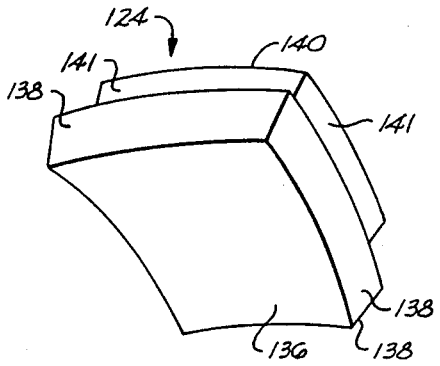
FIGS. 11*a* and 11*b* are perspective views of circumferential members constructed in accordance with the alternate embodiment puzzle illustrated in FIGS. 7 and 8.

FIG. 11*a* illustrates a recessed circumferential member 124. Adjacent curved bottom surface 136 of recessed circumferential member 124 are substantially radially extending side surfaces 138 which extend upwards from curved bottom surface 136. Radially extending side surfaces 138 are recessed at upper portions thereof, providing recessed portion 140 having recessed radially extending side surfaces 141.

Figure 11B:
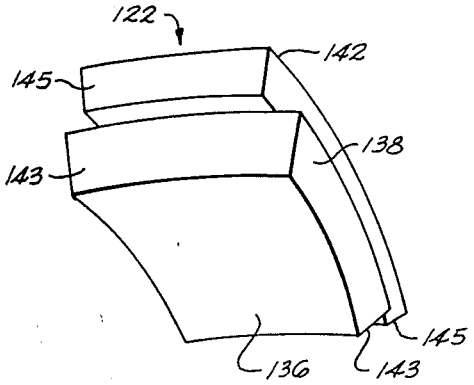

FIG. 11*b* illustrates projecting circumferential member 122. Extending upwardly from curved bottom surface 136 of projecting circumferential member 122 are radially extending surfaces 138. Also extending upwards from curved bottom surface 136 are tapered surfaces 143 for placement adjacent radially extending side surfaces 138 of recessed circumferential members 124. Adjacent upper portions of radially extending surfaces 138 of projecting circumferential member 122 is a projecting engagement flange 142 having tapered surfaces 145 for placement adjacent recessed radially extending side surfaces 141 of recessed circumferential member 124. Engagement flange 142 of projecting circumferential member 122 engages recess portion 140 of recessed circumferential member 124 when projecting circumferential member 122 and recessed circumferential member 124 are placed adjacent one another on tracks 116. Whenever two circumferential members 122 are adjacent each other flange 142 of one circumferential member 122 engages surface 119 of the adjacent circumferential member 122.

Throughout tracks 116 of puzzle 110 projecting circumferential members 122 and recessed circumferential members 124 are placed alternatingly with respect to one another. This allows for a projecting or recessed circumferential member 122, 124 to be retained on tracks 116 when at an intersection 120. While circumferential members 122, 124 have been illustrated as having an engagement flange-recessed portion interlocking means, it is to be understood that a wide variety of interlocking configurations and cooperating circumferential member profiles could be provided for ensuring that circumferential members 118 are retained on tracks 116 when at an intersection 120 of adjacent track members 114, and puzzle 110 is not limited to the engagement flange-recessed portion interlocking means herein illustrated and disclosed.

An important feature of puzzle 110 is that puzzle 110 may be disassembled upon the orienting of circumferential members 118 and/or track members 114 in a predetermined configuration. As illustrated in FIG. 8, disengagement circumferential members 144 are illustrated adjacent circumferential interface 128 and are provided with a straight cut portion 146 on curved bottom surface 136. Straight cut portion 146 extends substantially half the width of the bottom surface of disengagement circumferential members 144. When assembling puzzle 110, a predetermined number of disengagement circumferential members 144 are aligned around a circumference of a circumferential interface 128 so that only the disengagement circumferential members 144 having straight cut portions 146 of disengagement circumferential members 144 are oriented on the same side of circumferential interface 128. This allows for a remaining half 148, shown in phantom lines in FIG. 8, to be inserted beneath disengagement circumferential members 144 adjacent track members 114 on which disengagement circumferential members 144 are already carried. To retain remaining half 148 in puzzle 110, track members 114 are rotated relative to one another to cause circumferential members having entirely curved bottom surfaces 136 to straddle circumferential interface 128, thereby locking the remaining half 148 to puzzle 110 in a locking relationship.

To disassemble puzzle 110, a player must reorient disengagement circumferential members 144 so that only straight cut portions 146 are on one side of a single circumferential interface 128. Then, puzzle 110 could be readily disassembled. Such a feature could allow for promotional campaigns to be run wherein the player of puzzle 110 is given clues as to a certain word or other symbolic sequence which, if obtained on puzzle 110, would allow puzzle 110 to be readily disassembled. Another clue or item could be provided in the interior of puzzle 110 which would only be obtainable upon disassembly of puzzle 110.

Figure 9:
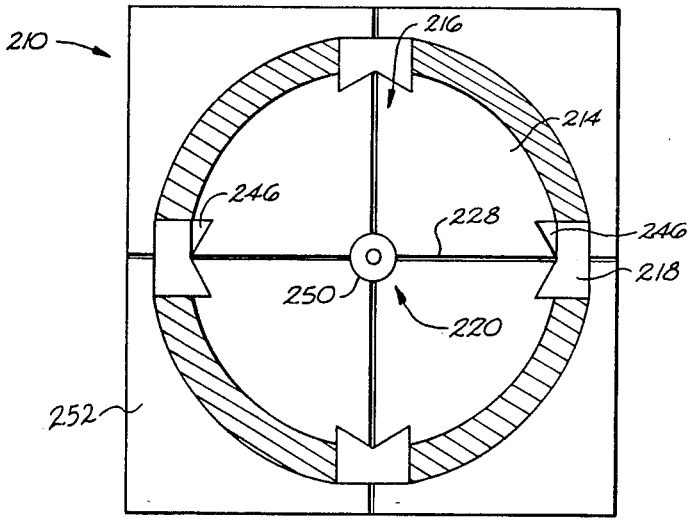
FIG. 9 is a sectional view of another alternate embodiment of a puzzle constructed in accordance with the present invention having concealed track members.

FIG. 9 illustrates a puzzle 210, another alternate embodiment of the present invention. Puzzle 210 includes track members 214, tracks 216 formed by adjacent edges of track members 214, and circumferential members 218. A pin 250 is provided at intersections 220 of puzzle 210 to prevent circumferential members 218 from rotating and moving into intersections 220 when corner members 252 are moved. Puzzle 210 is illustrated in FIG. 9 as being cubic in shape. Corner members 252 slidingly engage circumferential members 218, which are concealed beneath corner members 252. Concealed circumferential members 218 allow corner members 252 to be rotated relative to one another about a plurality of planes, thereby allowing games to be played with puzzle 210 such as the arranging of corner members 252 in a predetermined sequence or configuration.

Circumferential members 218 of puzzle 210 are provided with a predetermined number of straight cut portions 246. When only straight cut portions 246 of circumferential members 218 are aligned on one side of a single circumferential interface 228, puzzle 210 is readily disassembable in like manner as is puzzle 110. Assembly of puzzle 210 is accomplished in reverse manner by also arranging all of the straight cut portions 246 of circumferential members 218 on one side of a single circumferential interface 228.

Figure 10:
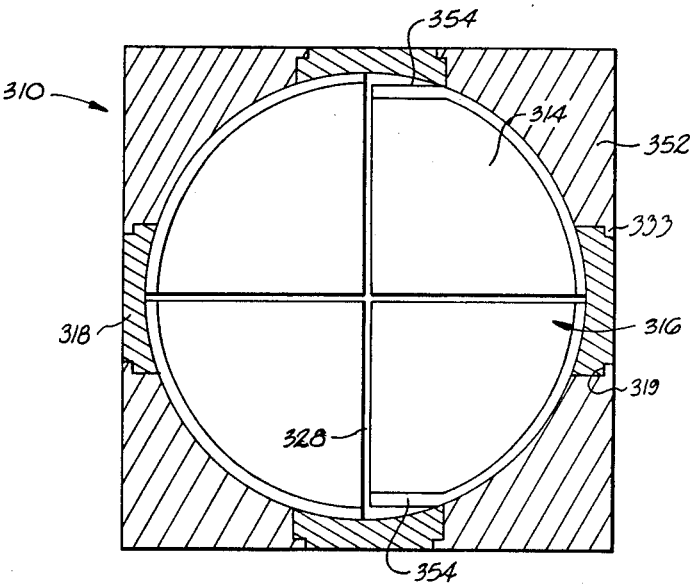
FIG. 10 is a sectional view of still another alternate embodiment constructed in accordance with the present invention having track members provided with disassembable means.

FIG. 10 illustrates a puzzle 310, another alternate embodiment of the present invention. Puzzle 310 includes track members 314, tracks 316 disposed between track members 314, circumferential members 318 for sliding engagement with tracks 116, and corner members 352 which are attached to track members 314.

Circumferential members 318 have engagement surfaces 319 for engaging circumferentially extending flanges 333 of corner members 352. similarly as discussed above regarding flanges 133 and engagement surfaces 119. Puzzle 310 is a cubic shape having circumferentially-extending tracks 316 passing through each side of cubic puzzle 310. A predetermined number of track members 314 of puzzle 310 are provided a release portion 354 which allows, upon proper configuration of circumferential members 318, for puzzle 310 to be disassembled. In order to disassemble puzzle 310, release portions 354 only of track members 314 must be oriented on the same side of a single circumferential interface 328. Assembly of puzzle 310 would also be accomplished in reverse manner when release portions 354 are all located on one side of a single circumferential interface 328. Corner members 352 of puzzle 310, in conjunction with circumferential members 318, allow for the number of games playable with puzzle 310 to be increased in that corner members 352 could be provided with colors, letters, or other symbols for coordination with circumferential members 318.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. A manipulatable game comprising:

a spherical support member;

a plurality of abutting track sections carried on said spherical support member contacting and covering said spherical support member;

a plurality of radially projecting straight edges carried on each of said track sections;

straight edges being in parallel abutment with one another on said spherical support member for creating a plurality of radially protruding circumferentially tracks which extend above the surface of said spherical support member; and a plurality of movable members, said movable members carried straddlingly on said radially protruding circumferential tracks for movement relative to said spherical support member.

2. A device as set forth in claim 1, further comprising:

spring flanges carried on said track sections;

said spring flanges being spaced above said straight edges; and said spring flanges contacting said movable members so that said movable members are urged towards said circumferential tracks.

3. The device as set forth in claim 2, wherein:

said movable members have a plurality of sides;

side grooves are carried on said sides of said movable members and extend for the length of said sides; and said grooves slidingly engage said spring flanges.

4. A device as set forth in claim 1 wherein:

said movable members are substantially square in shape and each have a top surface and a bottom surface; and said bottom surface of each said movable member is curved to complement the surface of said spherical support member.

5. The device as set forth in claim 1, wherein:

said movable members each have a top surface and a bottom surface;

a first groove and a second groove is carried on said bottom surface;

said first groove and said second groove are substantially perpendicular to one another and intersect at approximately the center of said bottom surface; and said first groove and said second groove are curved to complement the surface of said spherical support member.

6. The device as set forth in claim 1 further comprising:

said spherical support member having a smooth surface;

symbols carried on said smooth surface of said spherical support member; and symbols carried on said movable members.

7. The device as set forth in claim 1, wherein:

said track sections have openings through which the surface of said spherical support member may be viewed.

8. A manipulatable game piece, comprising:

a spherical support member;

a plurality of abutting track sections encompassing said spherical support member;

said abutting track sections forming a substantially spherical shell configuration about said spherical support member;

circumferential tracks formed at abutments of said track sections;

movable members carried on said circumferential tracks and including means cooperating with said abutting track sections for retaining said abutting track sections in said substantially spherical shell configuration by clamping said track sections together thereby, said movable members being shiftable on said circumferential tracks relative to said spherical support member; and means for selectively aligning said abutting track sections relative to said spherical support member along two different planes.

9. The game piece as set forth in claim 8 wherein:

said spherical shell formed by said abutting track sections and said spherical support member are in sufficient frictional contact so that said movable members may be moved on said circumferential tracks while said track sections remain stationary.

10. The game piece as set forth in claim 8, wherein said circumferential tracks include extended spring flanges for retaining said movable members within said circumferential tracks.

11. The game piece as set forth in claim 10, wherein each of said movable members are generally comprised of first and second elements comprising an integral member, but with one of said elements being generally radially inward of said spring flanges so as to be retained essentially within said circumferential tracks, and the other of said elements being essentially radially outward from said spring flanges so as to ride on the surface of said spring flanges.

12. The game piece as set forth in claim 11 wherein said other of said elements has a radially-inward extending portion which is joined with said one of said elements.

13. The game piece as set forth in claim 8 wherein said movable members comprise integral elements having first and second portions, with said first portions being retained generally within said tracks and said second portions being generally radially outward therefrom.

14. A manipulative game, comprising:

a plurality of track members joined together in substantially parallel alignment with one another to form a predetermined shape; said plurality of track members including a first track member and a second track member; said first track member being movable relative to said second track member; track means provided between said plurality of track member for allowing said first track member to be movable about a plurality of planes relative to said second track member; retention means including means engaging and movable relative to said track means for holding said plurality of track members in substantially parallel alignment with one another through engagement with said track means as said first track member is moved relative to said second track member; and means for disassembling said manipulative game through movement of said track members to a predetermined configuration with respect to said retention means.

15. The manipulative game as set forth in claim 14, wherein each of said plurality of track members includes an arcuate edge, said arcuate edge of each of said plurality of track members acting to form a plurality of circumferentially-extending interfaces between said plurality of track members upon the joining together of said plurality of track members for allowing said first track member to be movable about a plurality of planes relative to said second track member.

16. The manipulative game as set forth in claim 15, wherein said track means includes said arcuate edges of proximate track members acting in conjunction with one another to form circumferentially-extending tracks adjacent said circumferentially-extending interfaces formed between said plurality of track members.

17. The manipulative game as set forth in claim 15, wherein said track means includes curved border portions defined on proximate track members, said curved border portions acting in conjunction with one another to form circumferentially-extending tracks adjacent said circumferentially-extending interfaces formed between said plurality of track members.

18. The manipulative game as set forth in claim 17, wherein said means engaging and movable relative to said track means comprises circumferential members which slidingly engage said curved border portions of said track means for movement thereon.

19. The manipulative game as set forth in claim 18, wherein said circumferential members have a bottom surface being of curvature complementary to the curvature of said curved border portions so that upon engagement of said circumferential members with said curved border portions, said circumferential members retain said proximate track members together.

20. The manipulative game as set forth in claim 19, wherein said means for disassembling said manipulative game includes a predetermined number of said circumferential members having a straight cut portion on said bottom surface, so that when said predetermined number of said circumferential members are oriented on the manipulative game in a predetermined configuration, the manipulative game can be readily disassembled.

21. The manipulative game as set forth in claim 14, wherein said means engaging and movable relative to said track means comprises circumferential members which slidingly engage said track members for movement thereon.

22. The manipulative game as set forth in claim 21, wherein said means for disassembling said manipulative game includes said circumferential members having a predetermined number of disengagement portions which, when oriented on said plurality of track members in a predetermined configuration, allow the manipulative game to be readily disassembled.

23. The manipulative game as set forth in claim 21, wherein said means for disassembling said manipulative game includes at least one of said plurality of track members having a release portion which when oriented in a predetermined configuration with respect to said circumferential members allows the manipulative game to be readily disassembled.

24. The manipulative game as set forth in claim 14, wherein intersections are formed at the meeting of at least three proximate track members of said plurality of track members and wherein stop means are provided at said intersections for preventing movement of said retention means into said intersections.

25. The manipulative game as set forth in claim 24, wherein said stop means includes a pin provided in at least one of said intersections.

26. The manipulative game as set forth in claim 14, wherein intersections are formed at the meeting of at least three proximate track members of said plurality of track members and wherein said said independent retention means includes first circumferential members and second circumferential members, said first circumferential members having a first interlocking means for engaging and retaining said second circumferential members on said track means when said second circumferential members are at an intersection.

27. The manipulative game as set forth in claim 26, wherein said second circumferential members include second interlocking means; said second interlocking means comprising a recessed portion defined in said second circumferential members; and wherein said first interlocking means of said first circumferential member includes a projecting portion, said projecting portion of said first circumferential member engaging said recessed portion of said second circumferential member in an interlocking relationship.

28. The manipulative game as set forth in claim 26, wherein said first interlocking means of said first circumferential members engage and retain another said first circumferential members on said track means when said another first circumferential members are at an intersection.

29. A manipulative game, comprising:

a plurality of track members joined together in substantially parallel alignment with one another to form a predetermined shape; at least one arcuate edge provided on each of said plurality of track members, said arcuate edges acting to form a plurality of circumferentially-extending interfaces between said plurality of track members upon the joining together of said plurality of track members for allowing said plurality of track members to be movable relative to one another;

tracks provided between said plurality of track members for allowing at least one of said plurality of track members to be movable about a plurality of planes relative to the remaining said plurality of track members;

said tracks including said arcuate edges of proximate track members acting in conjunction to form circumferentially-extending tracks adjacent said circumferentially-extending interfaces formed between said plurality of track members;

retention means engaging said tracks for holding said plurality of track members adjacent one another through engagement with said tracks as said at least one of said plurality of track members is moved relative to the remaining said plurality of track members; said retention means including circumferential members which slidingly engage said tracks for movement thereon; intersections formed at the meeting of at least three proximate track members of said plurality of track members; said retention means including first circumferential members and second circumferential members, said first circumferential members having a projecting portion for engaging and retaining said second circumferential members on said tracks when said second circumferential members are at an intersection; and means for disassembling said manipulative game through movement of said track members to a predetermined configuration with respect to said retention means.

30. The manipulative game as set forth in claim 29, wherein said means for disassembling said manipulative game includes circumferential members having a predetermined number of disengagement portions which when oriented on said plurality of track members in a predetermined configuration, allow the manipulative game to be readily disassembled.

* * * * *